US007070181B2

(12) United States Patent
Ueng et al.

(10) Patent No.: US 7,070,181 B2
(45) Date of Patent: Jul. 4, 2006

(54) SYSTEMS AND METHODS FOR DETECTING BI-DIRECTIONAL PASSAGE OF AN OBJECT VIA AN ARTICULATED FLAG MEMBER ARRANGEMENT

(75) Inventors: Su-wen Ueng, Portland, OR (US); Barry G. Mannie, Tualatin, OR (US)

(73) Assignee: Xerox Corporation, Stamford, CT (US)

( * ) Notice: Subject to any disclaimer, the term of this patent is extended or adjusted under 35 U.S.C. 154(b) by 170 days.

(21) Appl. No.: 10/707,580

(22) Filed: Dec. 22, 2003

(65) Prior Publication Data

US 2005/0133992 A1 Jun. 23, 2005

(51) Int. Cl.
*B65H 7/02* (2006.01)

(52) U.S. Cl. ..... 271/258.01; 271/265.01; 399/16; 399/322; 399/389

(58) Field of Classification Search ..... 271/258.01, 271/265.01; 399/16, 322, 389; 73/865, 73/8

See application file for complete search history.

(56) References Cited

U.S. PATENT DOCUMENTS

| | | | | |
|---|---|---|---|---|
| 5,042,790 | A * | 8/1991 | Miller et al. | 271/110 |
| 5,582,399 | A * | 12/1996 | Sugiura | 271/10.11 |
| 5,680,651 | A * | 10/1997 | Tsuji et al. | 399/401 |
| 5,882,130 | A * | 3/1999 | Kumazaki et al. | 400/642 |
| 5,964,460 | A * | 10/1999 | Azumi et al. | 271/265.01 |
| 6,151,458 | A * | 11/2000 | Sato et al. | 399/16 |
| 6,215,965 | B1 * | 4/2001 | Sato | 399/16 |
| 6,615,017 | B1 * | 9/2003 | Tanaka | 399/322 |
| 6,783,026 | B1 * | 8/2004 | Chambers et al. | 271/265.01 |
| 6,926,272 | B1 * | 8/2005 | Carter et al. | 271/258.01 |
| 2004/0135311 | A1 * | 7/2004 | Chambers et al. | 271/265.01 |

* cited by examiner

*Primary Examiner*—Kathy Matecki
*Assistant Examiner*—Thomas Morrison
(74) *Attorney, Agent, or Firm*—Oliff & Berridge PLC

(57) ABSTRACT

An articulated flag member arrangement detects bi-directional passage of an object. In embodiments, the articulated flag member arrangement comprises a first flag member and a second flag member wherein the first and second flag members interact with each other to detect bi-directional passage of an object, for example, using the same sensor.

20 Claims, 14 Drawing Sheets

SYSTEMS AND METHODS FOR DETECTING BI-DIRECTIONAL PASSAGE OF AN OBJECT VIA AN ARTICULATED FLAG MEMBER ARRANGEMENT

BACKGROUND OF THE INVENTION

1. Field of Invention

This invention relates to systems and methods for detecting bi-directional passage of an object in a processing path by using an articulated member arrangement.

2. Description of Related Art

The sensor flags used in conventional sheet media handling devices may degrade system performance in several ways. The system performance may be degraded, for example by tearing the sheet of media, by breaking flags when attempting to remove a sheet of media from a processing path, by impairing image quality by reducing the uniform application of heat and/or pressure to the sheets of media, or by increasing the risk of interfering with other existing components of the sheet media handling device. Further, conventional designs commonly comprise unitary, single piece flags that require an increased slot size in the associated structures of the sheet media handling device, such as the pressure plate and/or heating plates of conventional copying, printing or document scanning devices. In such media handling devices, the increased slot size may either reduce the uniformity of heat and pressure distribution to a sheet of media as it travels in a processing path or provide a catch point for a sheet edge. In either case, image quality is reduced and/or system performance is reduced.

SUMMARY OF THE INVENTION

This invention provides detection of bi-directional travel of an object in a processing path.

This invention separately provides systems and methods that detect reversed travel of an object to reduce or eliminate damage to an imaging device and/or the system itself.

This invention separately provides detection of bi-directional travel of an object in a processing path using the same sensor.

This invention separately provides systems and methods for bi-directional detection that reduce costs and/or space requirements.

This invention separately provides for rapid detection of reverse direction of travel of an object in a processing path.

This invention separately provides reduced intrusion into a processing path to detect reverse direction of travel of an object in the processing path.

This invention separately provides systems and methods for detecting an object in a processing path in which damage to the object due to such detection is reduced.

This invention separately provides systems and methods for detecting an object in a processing path of an imaging device that reduce the need for service calls and/or maintenance and/or repairs and/or costs associated therewith.

In various exemplary embodiments of the systems and methods according to this invention, an articulated flag member arrangement comprises a first flag body having a first projection and a second flag body having a first projection. The first flag body may be pivotably connected to a device such that an object moving in a first direction and contacting the first projection of the first flag body rotates the first flag body in a second direction. The second flag body may be pivotably connected to the device such that an object moving in a direction opposite to the first direction and contacting the first projection of the second flag body rotates the second flag body in a direction opposite to the second direction. In embodiments, the first and second flag bodies interact such that at least one of the first and second flag bodies rotates based on rotation of the other of the first and second flag bodies.

In various exemplary embodiments, the second flag body interacts with the first flag body such that the first flag body rotates in the second direction based on rotation of the second flag body. In embodiments, the second flag body interacts with the first flag body such that the first flag body rotates in the second direction based on rotation of the second flag body further than the first flag body rotates in the second direction when an object moving in the first direction contacts the first projection of the first flag body.

In other various exemplary embodiments, the first flag body interacts with the second flag body such that the second flag body rotates in the direction opposite to the second direction based on rotation of the first flag body.

In various exemplary embodiments, the arrangement further comprises a sensor. In various embodiments, the sensor receives a signal when the first flag body is in a first position, the sensor being located such that a second projection of the first flag body prevents the sensor from receiving the signal when an object moving in the first direction contacts the first projection of the first flag body and rotates the first flag body into a second position, and such that the sensor receives the signal when the first flag body rotates in the second direction, based on rotation of the second flag body, into a third position. In other various embodiments, the sensor receives a signal when the second flag body is in a first position, the sensor being located such that a second projection of the second flag body prevents the sensor from receiving the signal when an object moving in a first direction contacts the first projection of the first flag body and rotates the second flag body into a second position, and such that the sensor receives the signal when an object moving in the direction opposite to the first direction contacts the first projection of the second flag body and rotates the second flag body in the direction opposite to the second direction into a third position.

In various exemplary embodiments of the systems and methods according to this invention, bi-directional passage of an object in a processing path is detected using an articulated flag member arrangement. In embodiments, the articulated flag member arrangement comprises a first flag body having a first projection, the first flag body pivotably connected to a device and a second flag body having a first projection, the second flag body pivotably connected to the device, wherein the first and second flag bodies are arranged to interact with each other.

In various exemplary embodiments, a signal is passed relative to one of the first and second flag bodies, passage of the signal indicating one of an at-rest position and an operated position of one of the first and second flag bodies. The first projection of the first flag body may be contacted with an object that is traveling in a processing path in a first direction, causing the first flag body to rotate in a second direction and to alter the passing of the signal. Further, the first projection of the second flag body may be contacted with an object that is traveling in a processing path in a direction opposite to the first direction, causing the second flag body to rotate in a direction opposite to the second direction and to alter the passing of the signal.

In various exemplary embodiments, the second flag body interacts with the first flag body such that the first flag body rotates in the second direction based on rotation of the second flag body. In other various exemplary embodiments, the first flag body interacts with the second flag body such that the second flag body rotates in the direction opposite to the second direction based on rotation of the first flag body.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail with reference to the following Figures, wherein.

DETAILED DESCRIPTION OF EXEMPLARY EMBODIMENTS

Figure 1:
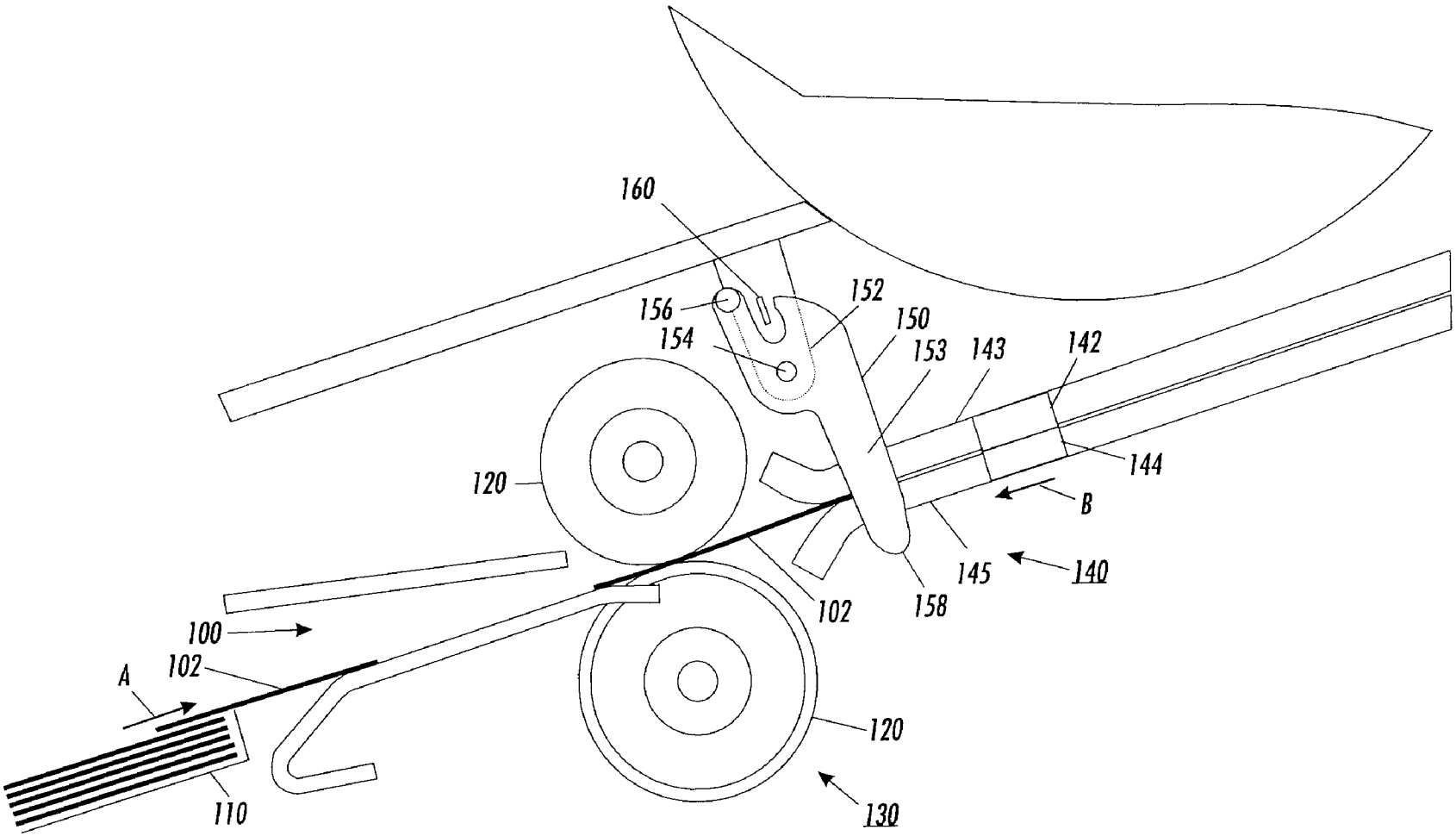
FIG. 1 shows a conventional single leg flag at rest.
Figure 2:
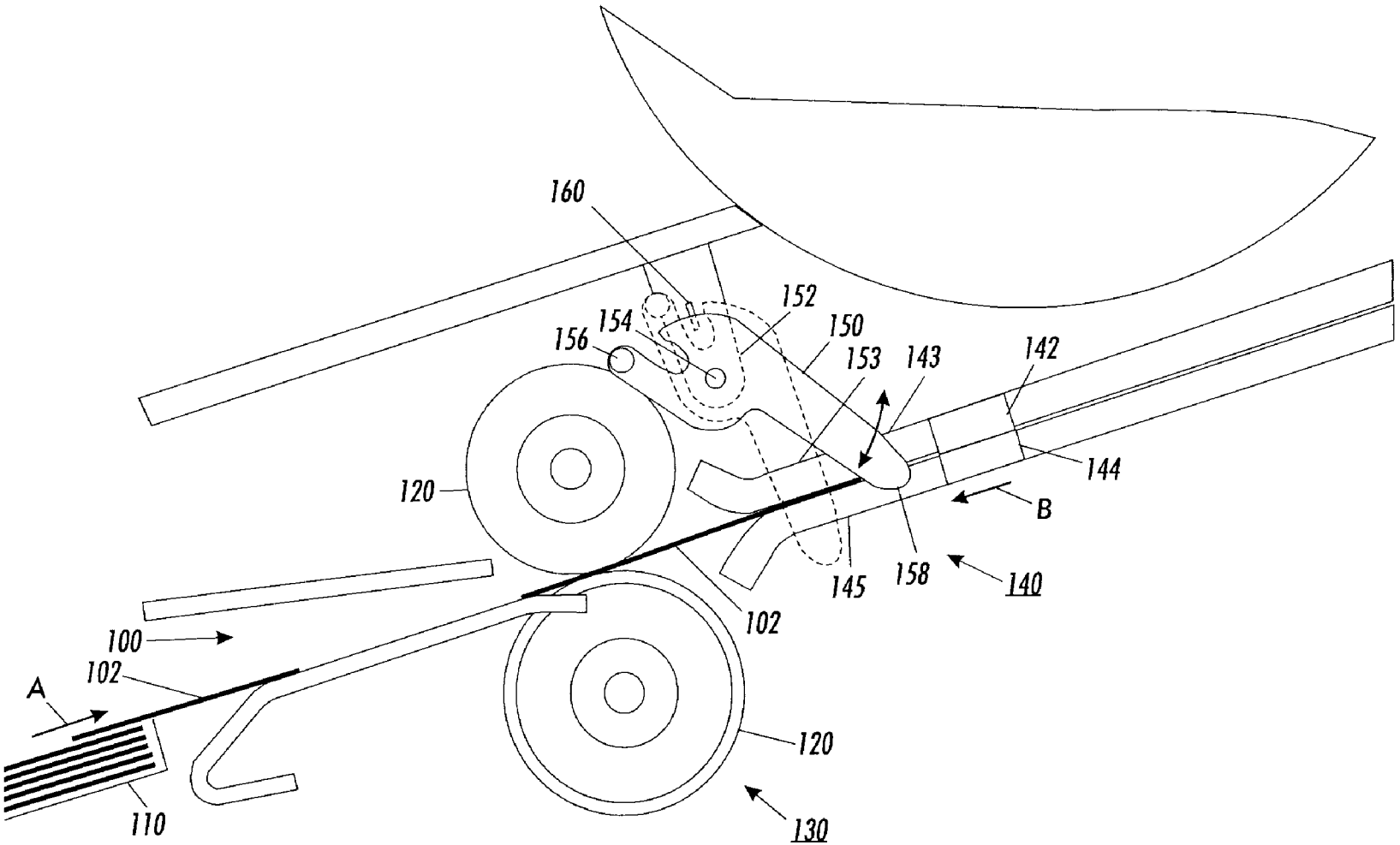
FIG. 2 shows the single leg flag of FIG. 1 as media proceeds in a direction of the processing path.
Figure 3:
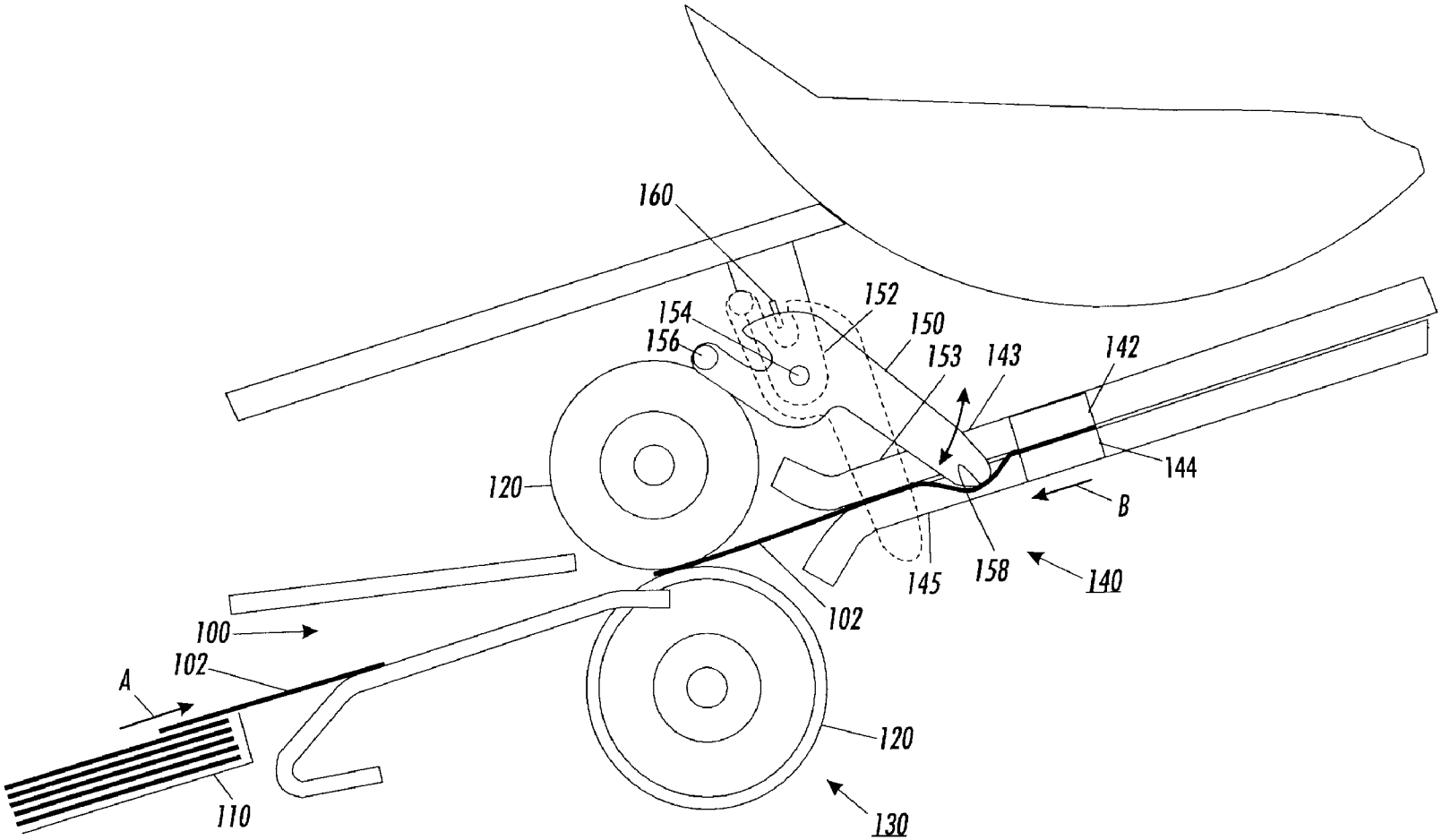
FIG. 3 shows the single leg flag of FIG. 1 as media proceeds in a direction reverse that of the processing path.

Conventional copying, scanning, printing and/or imaging devices, generally referred to as imaging devices hereafter, provide a processing path 100 through which media travels to produce a final copied and/or printed product. FIGS. 1–3 show, for example, a typical imaging device, in which a sheet of media 102 is provided from a paper tray 110 to a processing path 100 having an intended processing path 100 direction A. The sheet of media 102 is urged along the processing path 100 by driving rollers 120 that move the sheet of media 102 to a media heating stage 140. In the media heating stage 140, the sheet of media 102 travels through a pair of guiding plates to prepare the sheet of media 102 to evenly accept the image at the following stage. The sheet of media 102 then proceeds to subsequent processing stages or exits the imaging device as a final product.

As the sheet of media 102 travels along the processing path 100 by the urging of the driving rollers 120, for example, a single leg flag 150 may be used to identify a position or location of the sheet of media 102 as the sheet of media 102 travels from one stage to another in the processing path 100. The single leg flag 150 is rotatable about a pin 154 formed in an upper portion 152 of the flag 150. A stop 156 is also provided at an end of the upper portion 152 of the flag 150. The stop 156 restricts rotation of the flag 150 in a direction B opposite the direction A of the processing path 100. Thus, when the stop 156 is engaged, the flag 150 is essentially at rest and no sheet of media 102 can be urged in the direction B of the processing path 100.

The single leg flag 150 also includes a tip 158 at an end of a lower portion 153 of the flag 150. The tip 158 protrudes into slots 143 and 145 respectively formed in each of the plates 142 and 144. The slots 143 and 145 in the two plates 142 and 144 must be large enough to accommodate the flag tip 158 as the flag 150 rotates due to travel of the sheet of media 102 along the processing path 100. However, the slots 143 and 145 should also be small enough that the required heating and pressing of the sheet of media 102 by the two plates 142 and 144 is uniformly achieved to, for example, accurately and consistently solidify an image onto the sheet of media 102. The pressure plate 142 and heating plate 144 are both relatively small. Each of the pressure plate 142 and the heating plate 144 is, for example, approximately three inches long, and lies in the direction of the processing path 100. Accordingly, the length of the slots 143 and 145 and the corresponding length of the single leg flag 150 are limited.

As shown more particularly in FIGS. 1 and 2, the single leg flag 150 operates in conjunction with a sensor 160 that indicates a location or position of the sheet of media 102 along the processing path 100 according to the rotational position of the flag 150. Such a sensor 160 may be, for example, an optical sensor that has its path of light broken or obstructed when the single leg flag 150 rotates as the sheet of media 102 proceeds in a direction A along the processing path 100.

Thus, when the flag 150 is at rest, the sensor 160 is fully exposed and light is readily transmitted to the sensor 160. However, as the sheet of media 102 travels along the processing path 100 and the flag 150 rotates, the path of light to the sensor 160 eventually becomes fully blocked by the rotation of the flag 150. As a result, the location or position of the sheet of media 102 along the processing path 100 may be determined. Once the sheet of media 102 has moved past the flag 150, the flag 150 reverts to its at-rest position by gravity, or, for example, in view of some other biasing force. Once the flag 150 has reverted to its at-rest position, the sensor 160 is again fully exposed. By determining the location or position of the sheet of media 102 in this manner, a processing stage may be indicated as complete, and/or a subsequent processing stage may be authorized to begin.

If such a system is employed, for example, adjacent to a transfix nip or other portion of an imaging device when an object, such as image medium, being transported along a processing path of the imaging device in a first direction where the object may be subjected to movement in a direction opposite to the first direction, several problems may occur. Such a system is not designed to detect movement of the object in a direction opposite to the first direction. The flag of such a system may damage the object when the object moves in a direction opposite to the first direction. Further, the flag itself may be damaged when the object moves in a direction opposite to the first direction.

For example, as an object exits the transfix nip of an imaging device, a trailing edge of the object may remain stuck to a drum of the transfix nip. In a "pipeline" mode of the imaging device, the drum reverses its direction of rotation for processing the next object (e.g., sheet of media) in the processing path as the object is exiting. Thus, the object may follow the drum when reversed and be pulled back into the imaging device, for example, at a rate greater then the forward processing rate.

Conventional flags are not designed for such a situation. Further, even if a conventional flag could function without being damaged or without damaging the object in such a situation, the reversal of the object cannot be detected fast enough to detect a fault and prevent jamming and/or damage to the imaging device, including catastrophic failures. Conventional flags may not even detect a fault at all until a subsequent object jams or an image is missing from a subsequent processed object.

In various exemplary embodiments of the systems and methods according to this invention, such fast reversal of an object in a processing path of a media device is detected. In embodiments, the systems and methods involve an articulated flag member arrangement comprising a first flag member and a second flag member wherein the first and second flag members interact with each other to detect bi-directional passage of an object.

Figure 4:
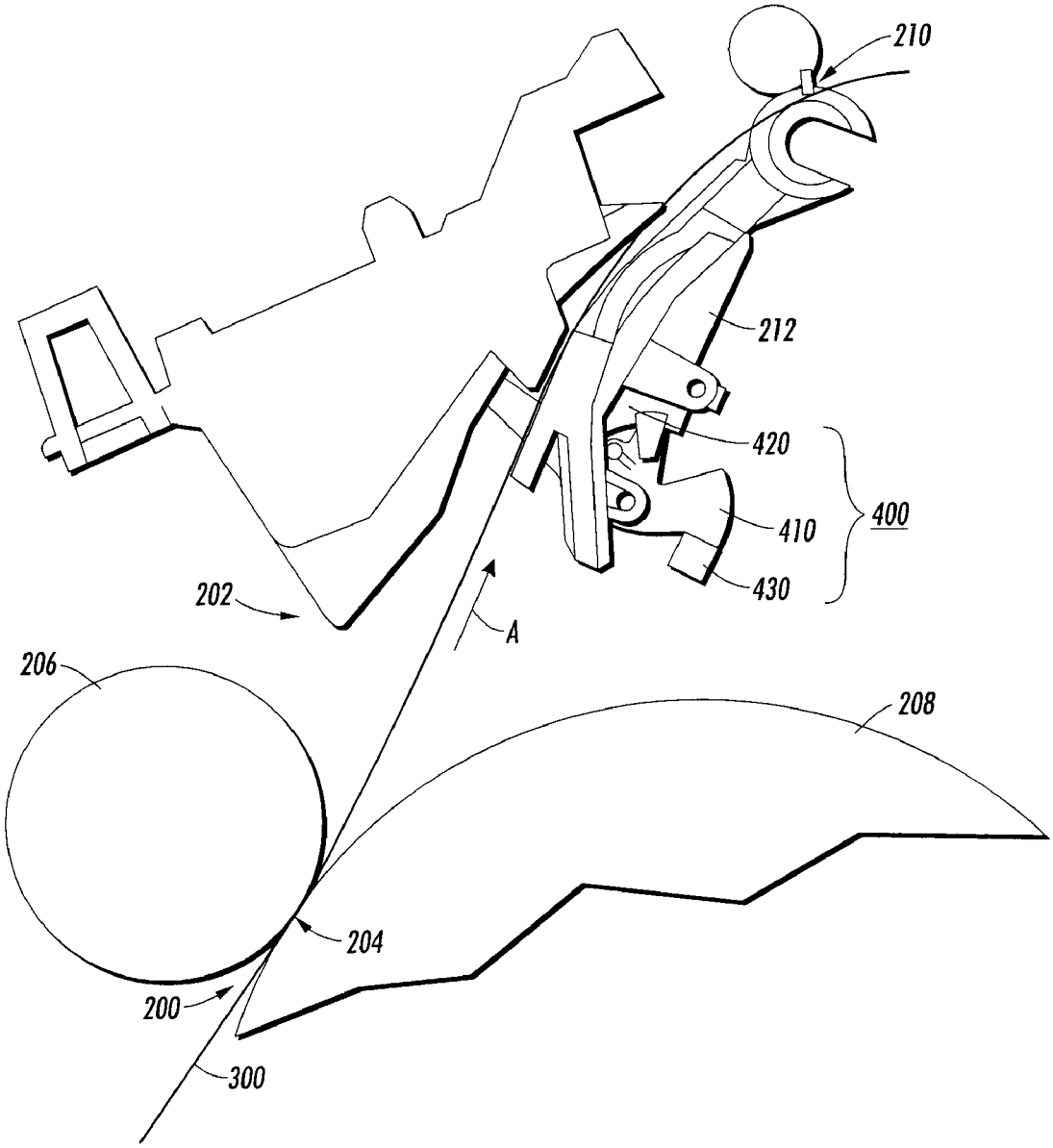
FIG. 4 shows a first exemplary embodiment of an articulated flag member arrangement according to this invention.

FIG. 4 shows a first exemplary embodiment of an articulated flag member arrangement 400. As shown, the articulated flag member arrangement 400 is located in an processing path 200 of an imaging device (not shown) at an exit 202 of a transfix nip 204 defined by a transfix roller 206 and a drum 208. It should be understood that the depiction of the processing path 200 of the imaging device is illustrative and that the articulated flag member arrangement 400 may be used in various devices and in various processing paths as desired.

The articulated flag member arrangement 400 may be located between the transfix nip 204 and an exit nip 210 as shown. As an object 300 travels through the processing path 200, the object 300 is fed through the transfix nip 204 over a portion 212 of the imaging device, such as an exit guide, and to the exit nip 210. When a leading edge of the object 300 reaches the exit nip 210, the object 300 is pulled by the exit nip 210.

As shown in FIG. 4, the articulated flag member arrangement 400 comprises a first flag body 410 and a second flag body 420. As described herein, the first flag body 410 and the second flag body 420 are arranged to interact with each other. In the first embodiment, the first flag body 410 and the second flag body 420 are pivotably connected to the imaging device at portion 212. As shown in FIG. 4, the first flag body 410 is in a first position, which may be an at rest position of the first flag body 410.

A sensor 430 is arranged relative to the first flag body 410 and the second flag body 420 to detect changes in the positions of the first flag body 410 and the second flag body 420, as described herein. The sensor 430 may be any suitable sensor, either known or hereafter developed, that is capable of sensing changes in the positions of the flag bodies 410, 420. For example, the sensor 430 may be an optical sensor that detects the passage of a signal. As described herein, passage of the signal may be altered by the either or both of the flag bodies 410, 420 in accordance with the positions of the flag bodies 410, 420. It should be understood that such alteration of the signal may comprise blocking, redirecting, attenuating or otherwise altering the signal.

Figure 5:
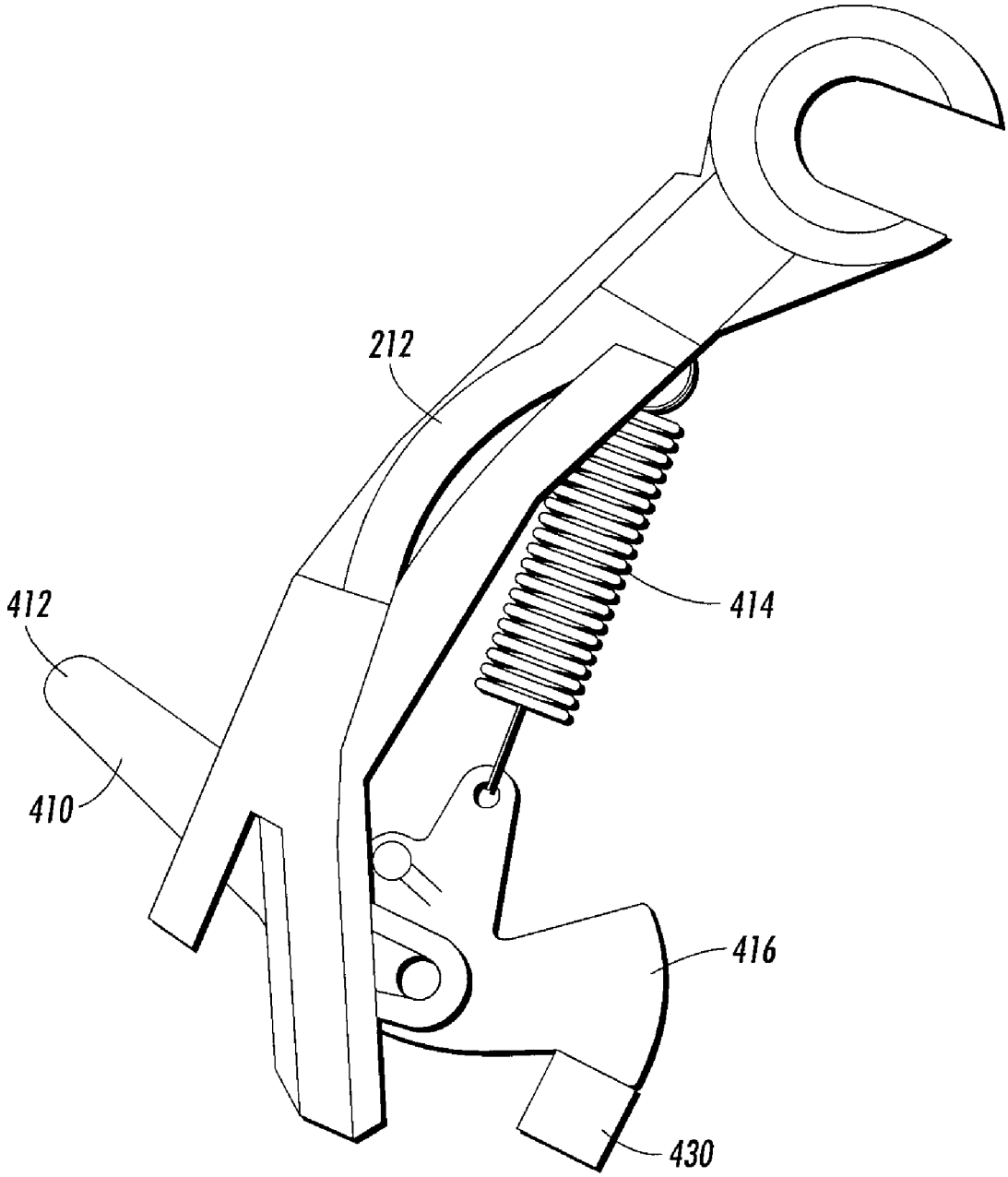
FIGS. 5–7 illustrate a normal operation sequence of the first exemplary embodiment.
Figure 6:
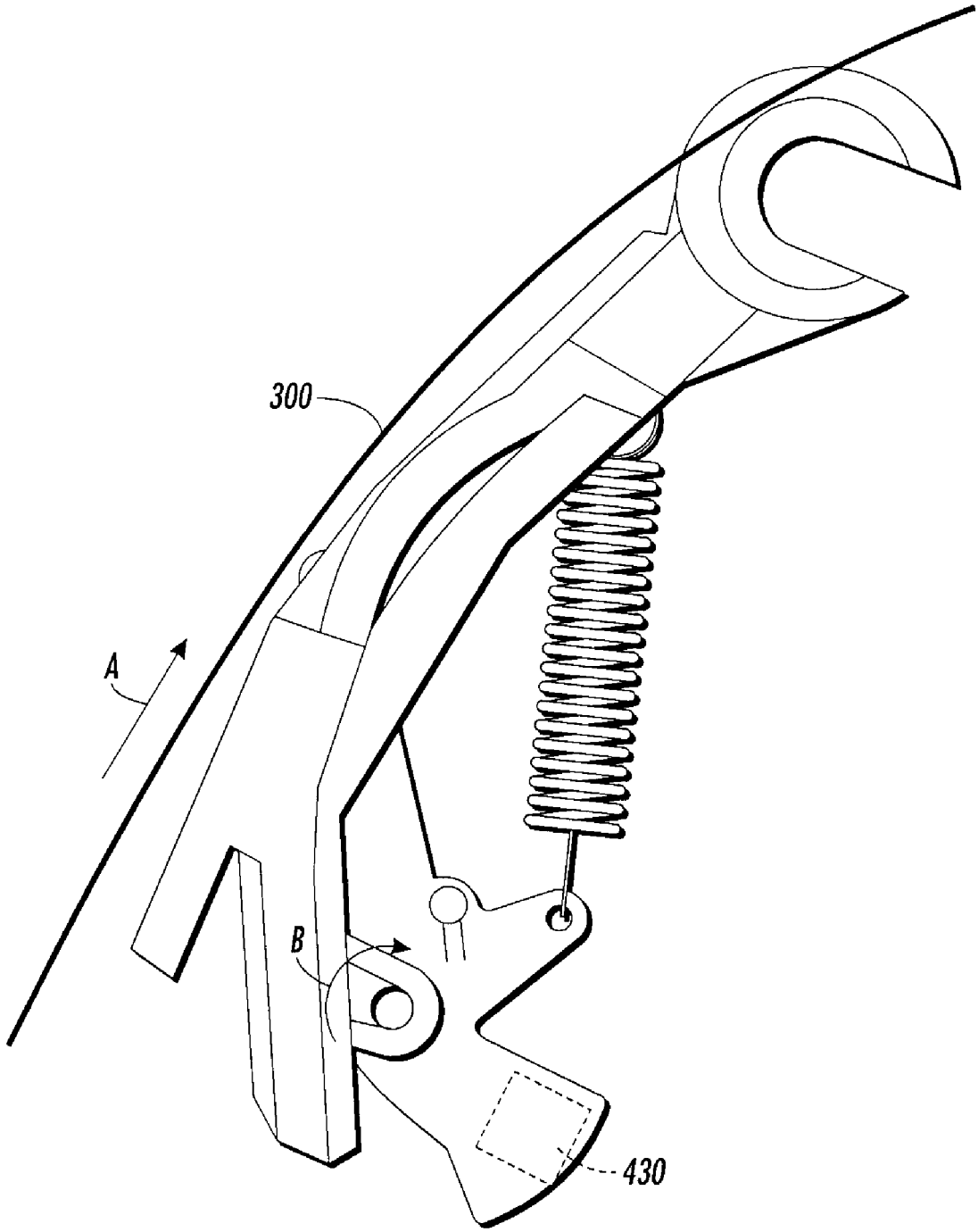
Figure 7:
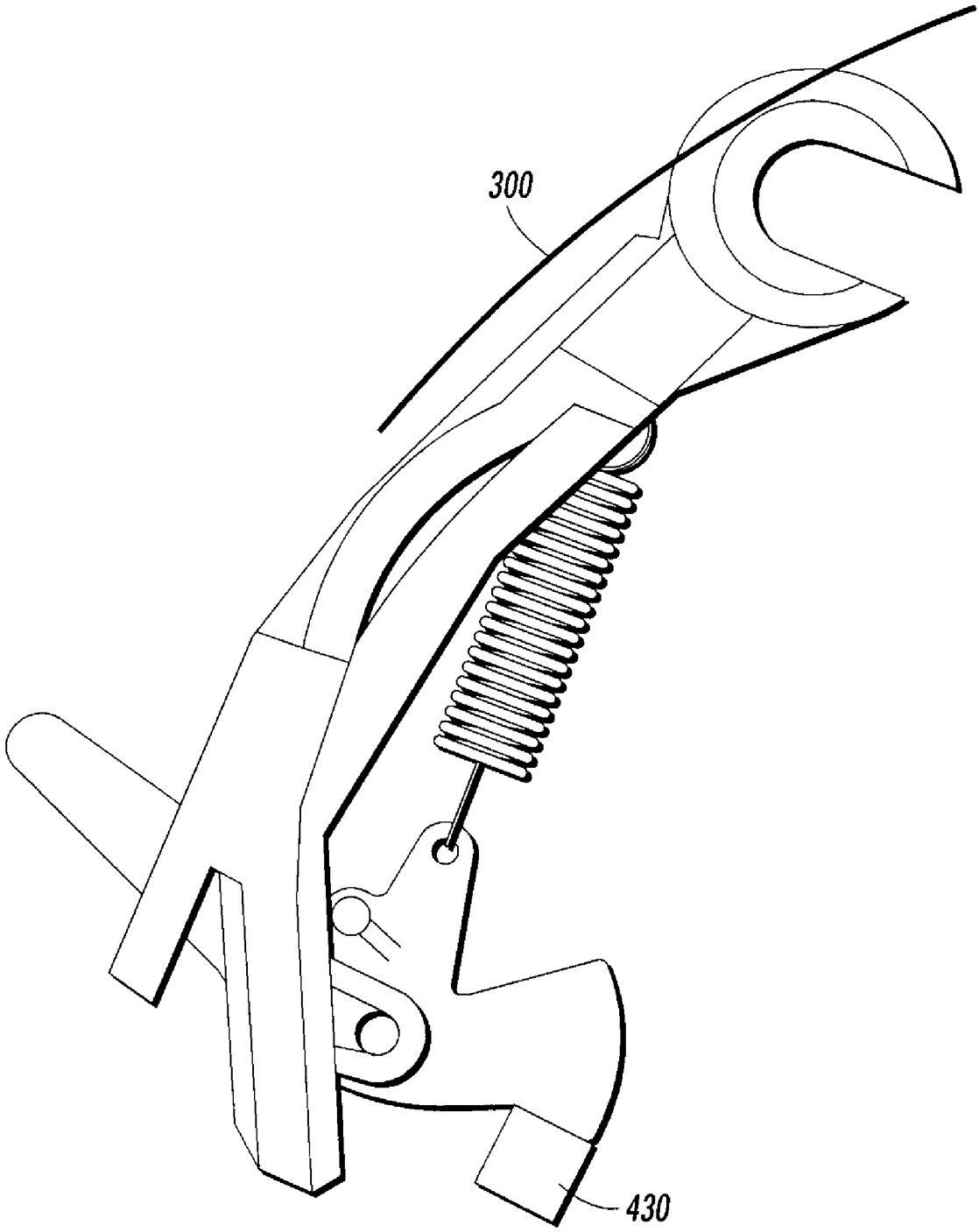

FIGS. 5–7 illustrate an exemplary normal operation sequence of the articulated flag member arrangement 400, the second flag body and other details shown in FIG. 4 being omitted for the sake of clarity. The first flag body 410 has a first projection 412 that extends into the processing path 200, for example, beyond a surface of the portion 212 that partially defines the processing path 200. As shown in FIG. 5, the first flag body 410 is in the first position, which is an at rest position of the first flag body 410. As also shown, a biasing member 414 may be included to bias the first flag body 410 toward the first position. The biasing member 414 may be any suitable device, either known or hereafter developed, that is capable of biasing the first flag body 410. For example, the biasing member 414 may be a coil spring as shown.

In the first position, the first flag body 410 may allow the sensor 430 to receive an unaltered signal. For example, the sensor 430 may be unblocked when the first flag body 410 is in the first position. It should be understood, however, that the first flag body 410 may block the sensor from receiving a signal if desired. The only requirement is that the signal received by the sensor 430 is altered by a change in the position of the first flag body 410, as described herein.

As the object 300 proceeds in a first direction shown by arrow A along the processing path 200, the object 300 contacts the first projection 412 of the first flag body 410 and causes the first flag body 410 to rotate in a second direction as shown by arrow B. Thus, the object traveling in the first direction contacts the first flag body 410 and causes the first flag body to rotate from the first position shown in FIG. 5 to a second position as shown in FIG. 6. The change in the position of the first flag body 410 alters the signal that is received by the sensor 430. For example, the sensor 430 may be blocked from receiving the signal. As shown in FIG. 6, the first flag body 410 blocks the sensor 430 when in the second position, for example, by a second projection 416 of the first flag body 410.

As the object 300 continues in the first direction, a trailing edge of the object 300 clears the first projection 412 of the first flag body 410. As shown in FIG. 7, when this occurs, the first flag body 410 returns to the first position in which the first flag body 410 allows the sensor 430 to receive an unaltered signal. For example, the first flag body 410 may rotate in a direction opposite the second direction to return to the first position. The biasing member 414 may be used to help the first flag body 410 return to the first position.

As described with respect to FIGS. 5–7, the articulated flag member arrangement 400 detects an object traveling in the first direction along the processing path 200. The articulated flag member arrangement 400 also detects an object traveling along the processing path 200 in a direction opposite to the first direction.

Figure 8:
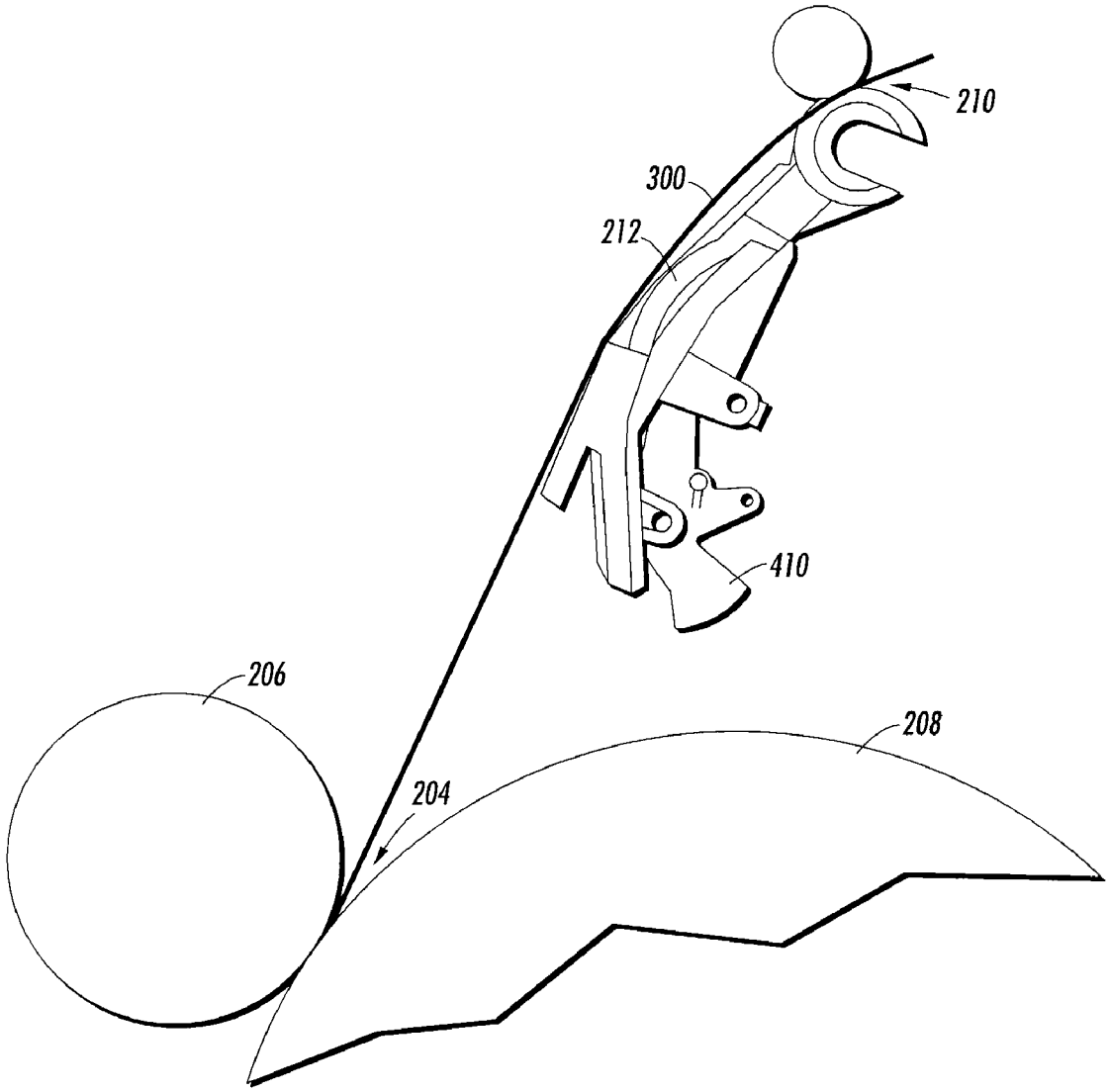
FIG. 8 illustrates the situation when an object (media) is stuck to a drum of an imaging device with the first exemplary embodiment in a processing path thereof.

If the object 300 reverses direction and travels in a direction opposite to the first direction, the second flag body 420 of the articulated flag member arrangement 400 will be activated. For example, as shown in FIG. 8, as a trailing edge of the object 300 is leaving the transfix nip 204, the trailing edge may be stuck to the drum 208, for example, because of a small transfix gap between the transfix roller 206 and the drum 208 or because of a lack of oil on the drum 208. The pull on a leading edge of the object 300 by the exit nip 210 may not be sufficient to dislodge the object from the drum 208, so that the object 300 will be driven in a direction opposite to the first direction when the drum 208 reverses its direction of rotation, for example, for a subsequent object.

Figure 9:
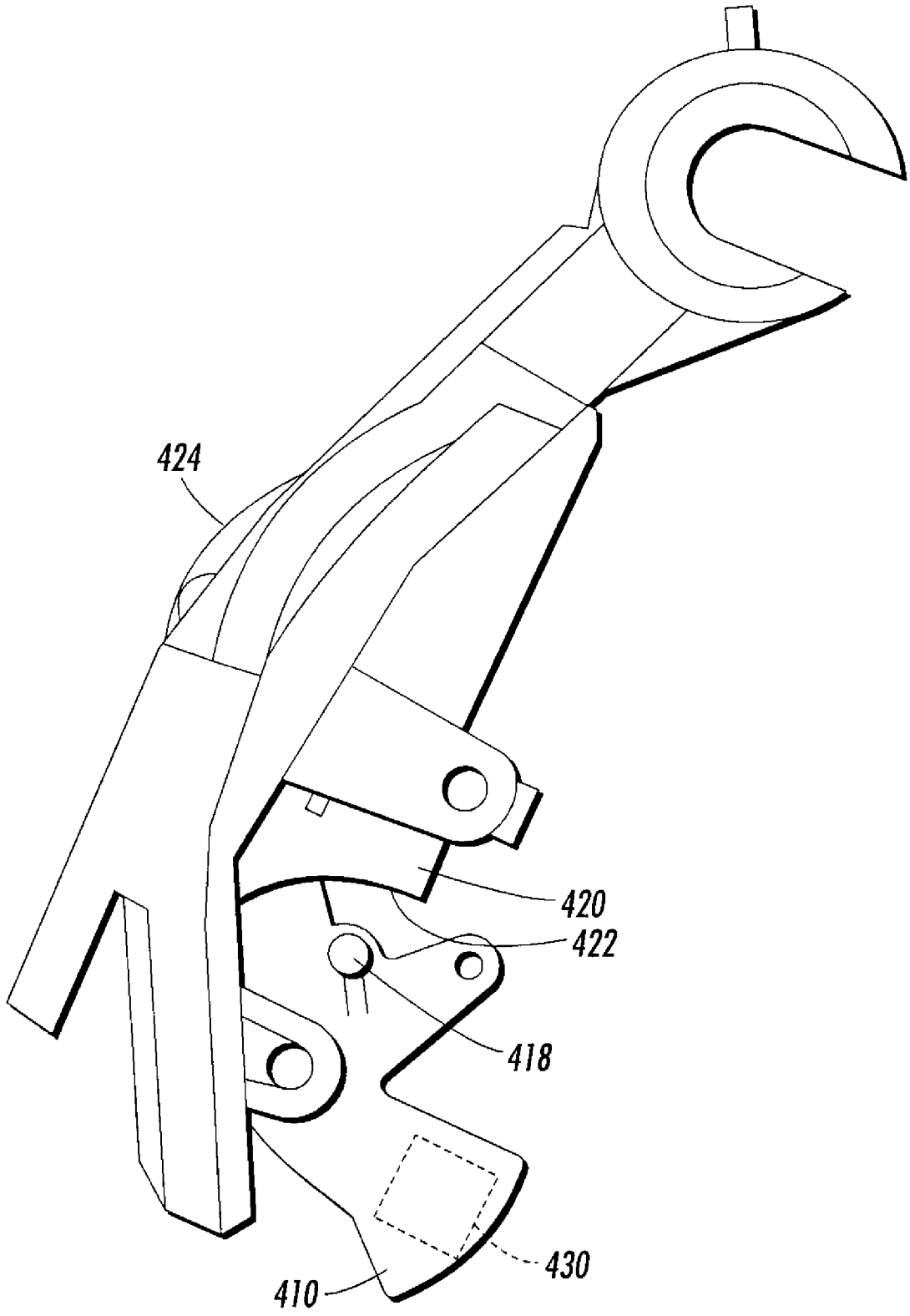
FIGS. 9–10 illustrate an operation sequence of the first exemplary embodiment before and during reversal of the object in the processing path, respectively.
Figure 10:
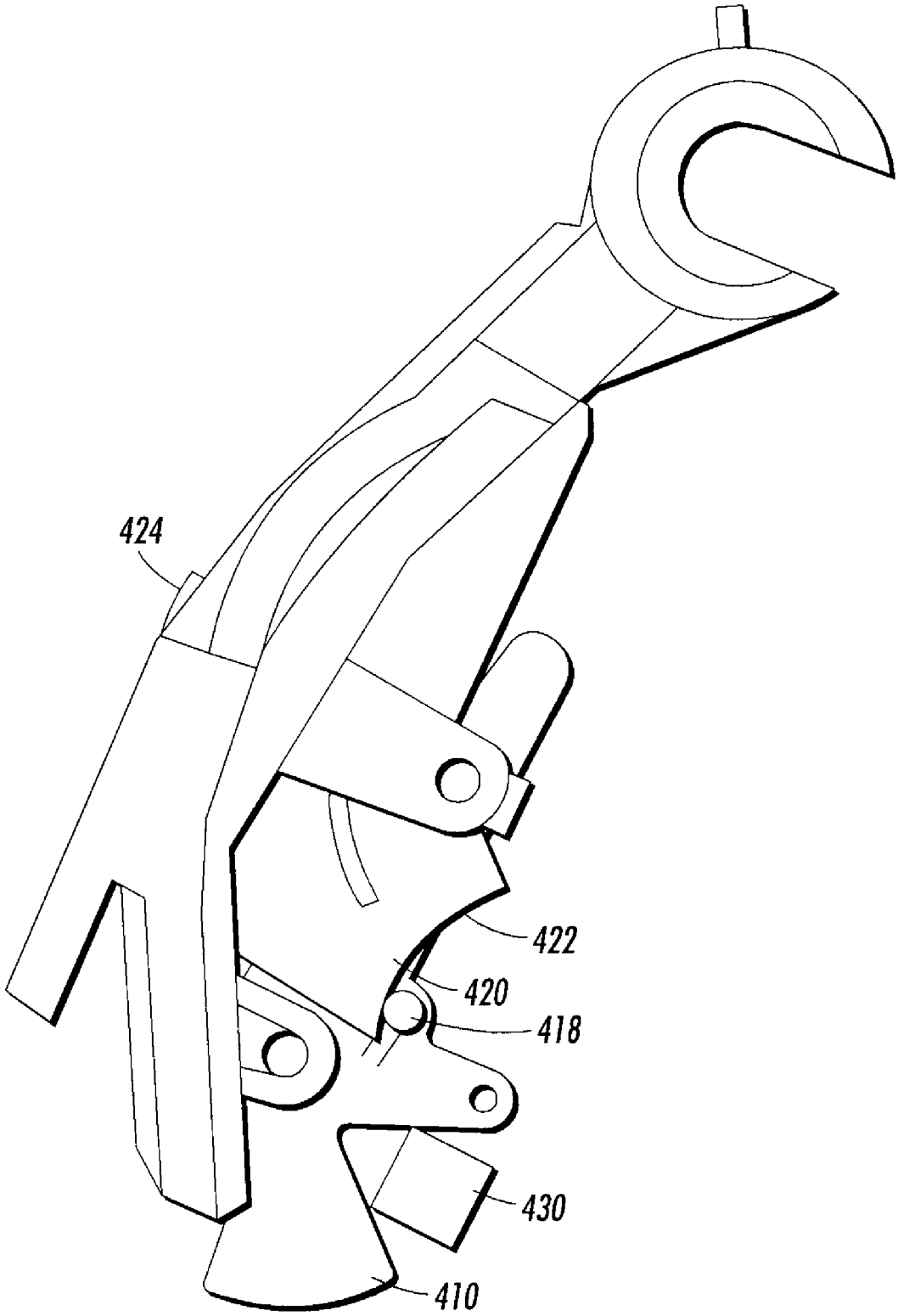

As the object is pulled by the exit nip 210 and engaged at the transfix nip 204, the object 300 is pulled taut against the portion 212 of the imaging device, as shown in FIG. 8. FIGS. 9–10 illustrate an operation sequence of the articulated flag member arrangement 400 before and during reversal of the object in the processing path, respectively. Prior to any movement of the object 300 in the direction opposite to the first direction, the first flag body 410 is in the second position, as shown in FIG. 9, wherein the sensor 430 is blocked.

As shown in FIG. 9, the second flag body 420 is disposed in a first position in which the second flag body 420 contacts or almost contacts the first flag body 410. The second flag body 420 may be disposed in a first position in which the second flag body 420 is as close to contacting the first flag body 410 as is needed for a given application. For example, in the exemplary embodiment wherein the articulated flag member arrangement 400 is located between the transfix nip 204 and the exit nip 210 of an imaging device, the second flag body 420 may be disposed in a first position in which the second flag body 420 is close enough to contacting the first flag body 410 that the articulated flag member arrangement 400 may detect movement of the object 300 in the direction opposite to the first direction within milliseconds of the drum 208 reversing its direction of rotation.

Although not shown, a biasing member may be included to bias the second flag body 420 toward its first position. This biasing member may be similar to the biasing member 414 associated with the first flag body 410.

The first and/or second flag bodies 410, 420 may have a lateral projection, such as a post 418 on the first flag body 410 shown in FIGS. 9–10. Further, the first and/or second flag bodies 410, 420 may have a corresponding surface, such as a curved surface 422 on the second flag body 420 shown in FIGS. 9–10, that cooperates with the post 418 or other lateral projection as the second flag body 420 moves into contact with the first flag body 410.

As the object 300 moves in the direction opposite to the first direction, the object 300 contacts a first projection 424 of the second flag body 420 that extends into the processing path 200, for example, beyond a surface of the portion 212 that partially defines the processing path 200. The first projection 424 of the second flag body 420 may not extend very far into the processing path 200 beyond the surface of the portion 212 so as not to interfere with movement of the object 300 in the first direction or otherwise damage the object 300 as the object 300 passes. Further, the first projection 424 of the second flag body 420 may present a surface that is gradually curved in each direction to help avoid causing damage to the object 300. The contact between the object 300 and the first projection 424 of the second flag body 420 may be a frictional contact, for example, due to the tautness of the object 300 between the exit nip 210 and the drum 208.

As shown in FIG. 9, the second flag body 420 is in the first position, which may be an at rest position of the second flag body 420, prior to movement of the object 300 in the direction opposite to the first direction. In the first position, the first projection 424 of the second flag body 420 is only slightly visible beyond the surface of the portion 212.

Movement of the object 300 in the direction opposite to the first direction while contacting the first projection 424 of the second flag body 420 causes the second flag body 420 to rotate in a direction opposite to the second direction, i.e., opposite to the rotation of the first flag body 410 described above. As the second flag body 420 rotates, the curved surface 422 of the second flag body 420 contacts the post 418 of the first flag body 410, causing the first flag body 410 to rotate further in the second direction.

Further rotation of the first flag body 410 in the second direction moves the first flag body into a third position, as shown in FIG. 10. In the third position, the first flag body 410 alters the signal that the sensor 430 receives. For example, as shown in FIG. 10, the sensor 430 may be unblocked when the first flag body 410 is moved into the third position by its interaction with the second flag body 420. The change in the signal received by the sensor 430 indicates movement of the object in the direction opposite to the first direction, whereby the articulated flag member arrangement 400 detects movement in the direction opposite to the first direction.

During normal exiting of the object 300 past the portion 212, the first flag body 410 returns to its first position, for example, in which the sensor 430 is unblocked. The sensor 430 may be communicated with firmware that can determine a timing difference between the unblocking of the sensor 430 when the first flag body 410 returns to its first position during normal exiting and the unblocking of the sensor 430 when the first flag body 410 move into its third position during reversal of the direction of travel of the object 300.

Thus, the articulated flag member arrangement 400 is capable of detecting bi-directional movement of the object 300 along the process path 200. Because the articulated flag member arrangement 400 uses the same sensor 430 to detect both forward and reverse directions, the number of parts is reduced.

Figure 11:
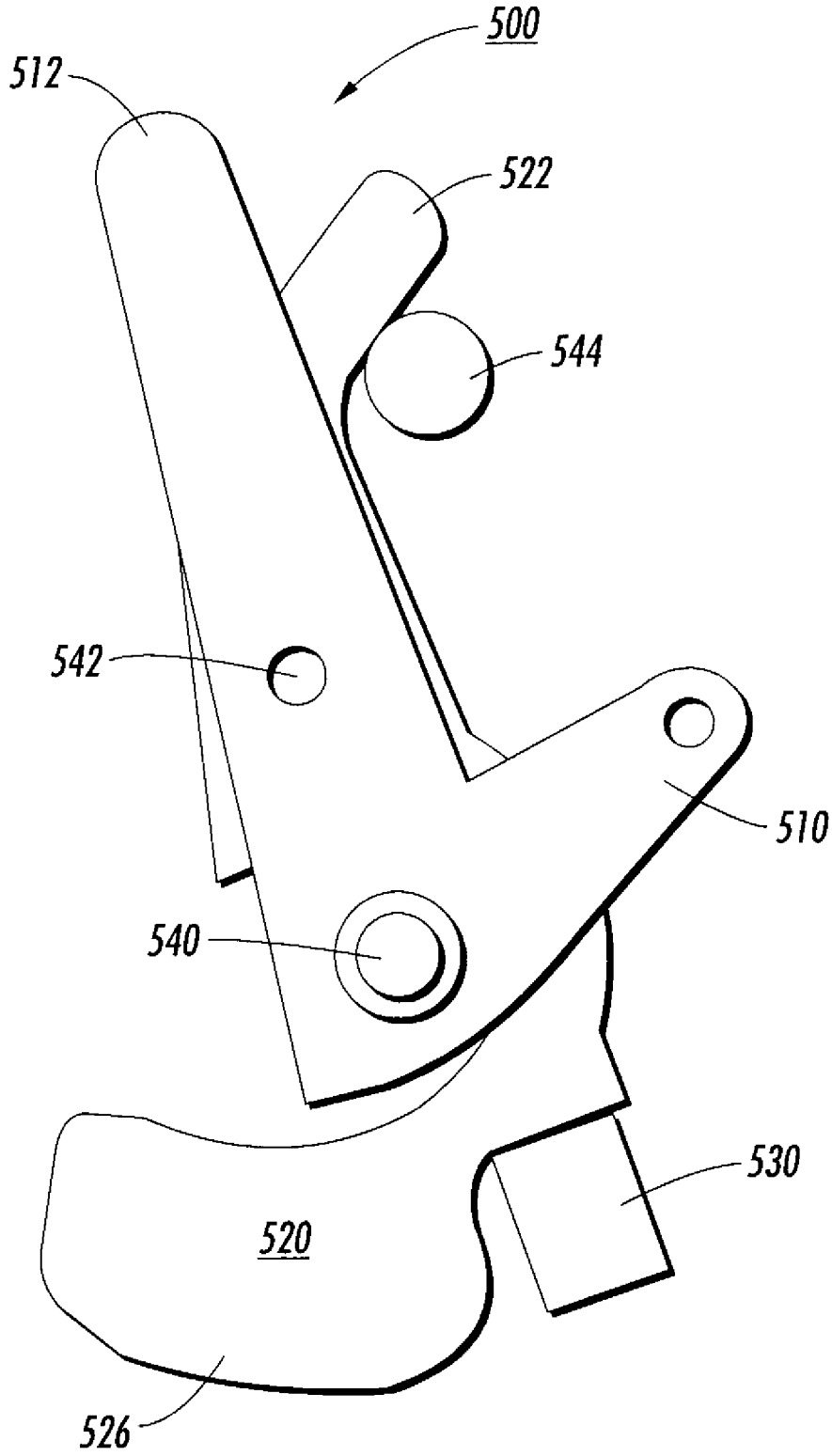
FIGS. 11–14 illustrate an operation sequence of a second exemplary embodiment an articulated flag member arrangement according to this invention

FIG. 11 shows a second exemplary embodiment of an articulated flag member arrangement 500 and FIGS. 11–14 illustrate an exemplary operation sequence of the articulated flag member arrangement 500. As shown, the articulated flag member arrangement 500 comprises a first flag body 510 and a second flag body 520. As described herein, the first flag body 510 and the second flag body 520 are arranged to interact with each other. In the second embodiment, the first flag body 510 is pivotably connected to the imaging device at a pivot point 540. The second flag body 520 is pivotably connected to the first flag body 510 at a pivot point 542. As shown in FIG. 11, the first and second flag bodies 510, 520 are in respective first positions, which may be respective rest positions of the first and second flag bodies 510, 520.

A sensor 530 is arranged relative to the first and second flag bodies 510, 520 to detect changes in the positions of the first and second flag bodies 510, 520, as described herein. The sensor 530 may be similar to the sensor 430 described above with respect to the first exemplary embodiment.

The first flag body 510 has a first projection 512 that extends into the processing path as described above with respect to the first exemplary embodiment. As with the first exemplary embodiment, the first flag body 510 may have a biasing member to bias the first flag body 510 toward the first position shown in FIG. 11.

The second flag body 520 has a first projection 522 that may or may not extend into the processing path when the second flag body 520 is in its first position, as shown in FIG. 11. As with the first exemplary embodiment, the second flag body 520 may have a biasing member to bias the second flag body 520 toward the first position shown in FIG. 11. In the second exemplary embodiment, the biasing members may be torsion springs situated about the respective pivot points 540, 542.

In the first position, the second flag body 520 may allow the sensor 530 to receive an unaltered signal. For example, as shown, the sensor 530 may be unblocked when the second flag body 520 is in the first position.

Figure 12:
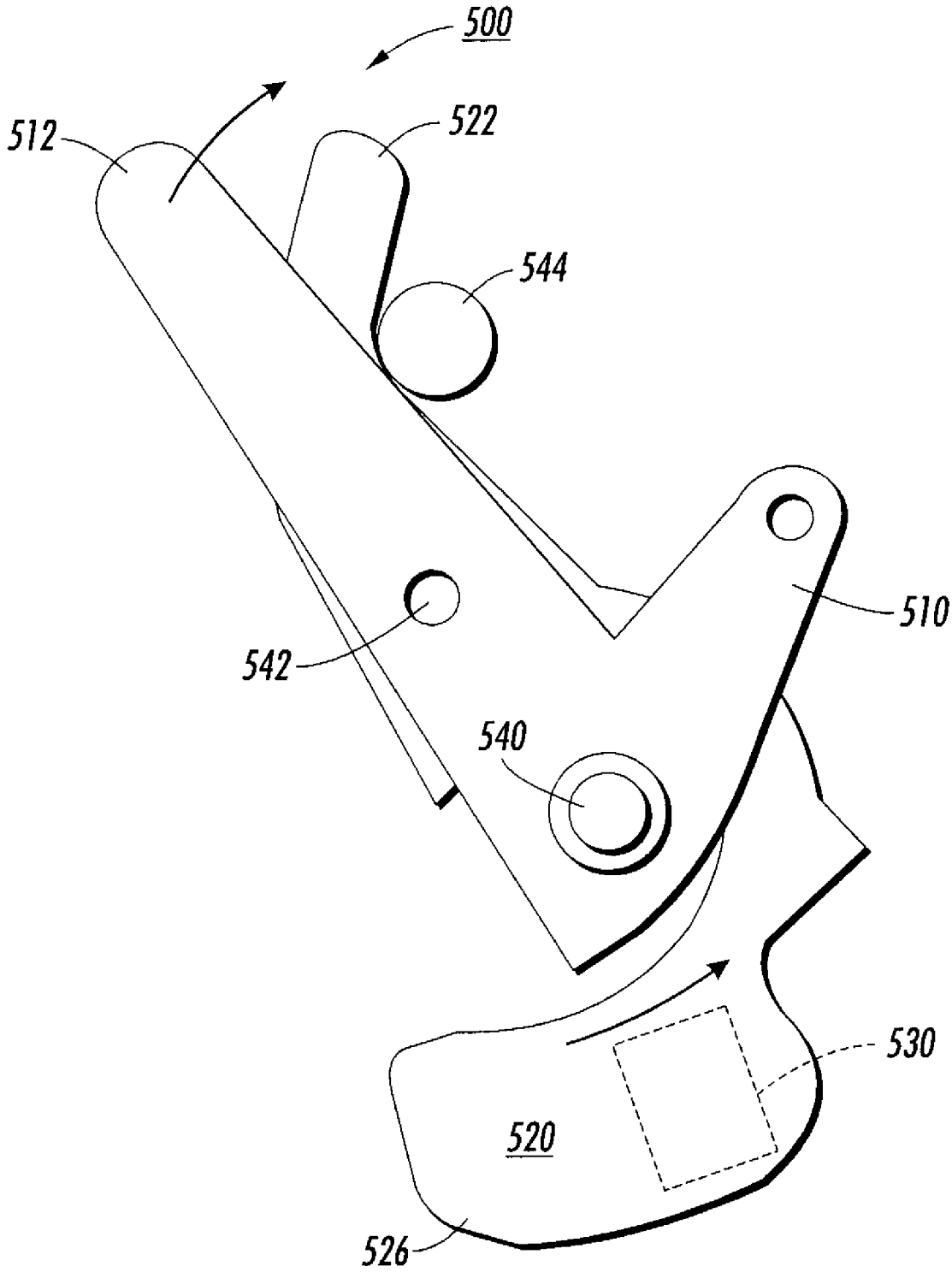

As the object 300 proceeds in the first direction along the processing path, the object 300 contacts the first projection 512 of the first flag body 510 and causes the first flag body 510 to rotate in the second direction. Thus, the object traveling in the first direction contacts the first flag body 510 and causes the first flag body 510 to rotate from the first position shown in FIG. 11 to a second position as shown in FIG. 12.

Because the second flag body 520 is pivotably connected to the first flag body 510, the second flag body 520 moves with the first flag body 510. However, as the second flag body 520 moves in the second direction with the first flag body 510, the second flag body 520 contacts a fixed stop 544. The fixed stop 544 may be a post or other suitable structure that is connected to the imaging device and does not move relative to the processing path.

Figure 13:
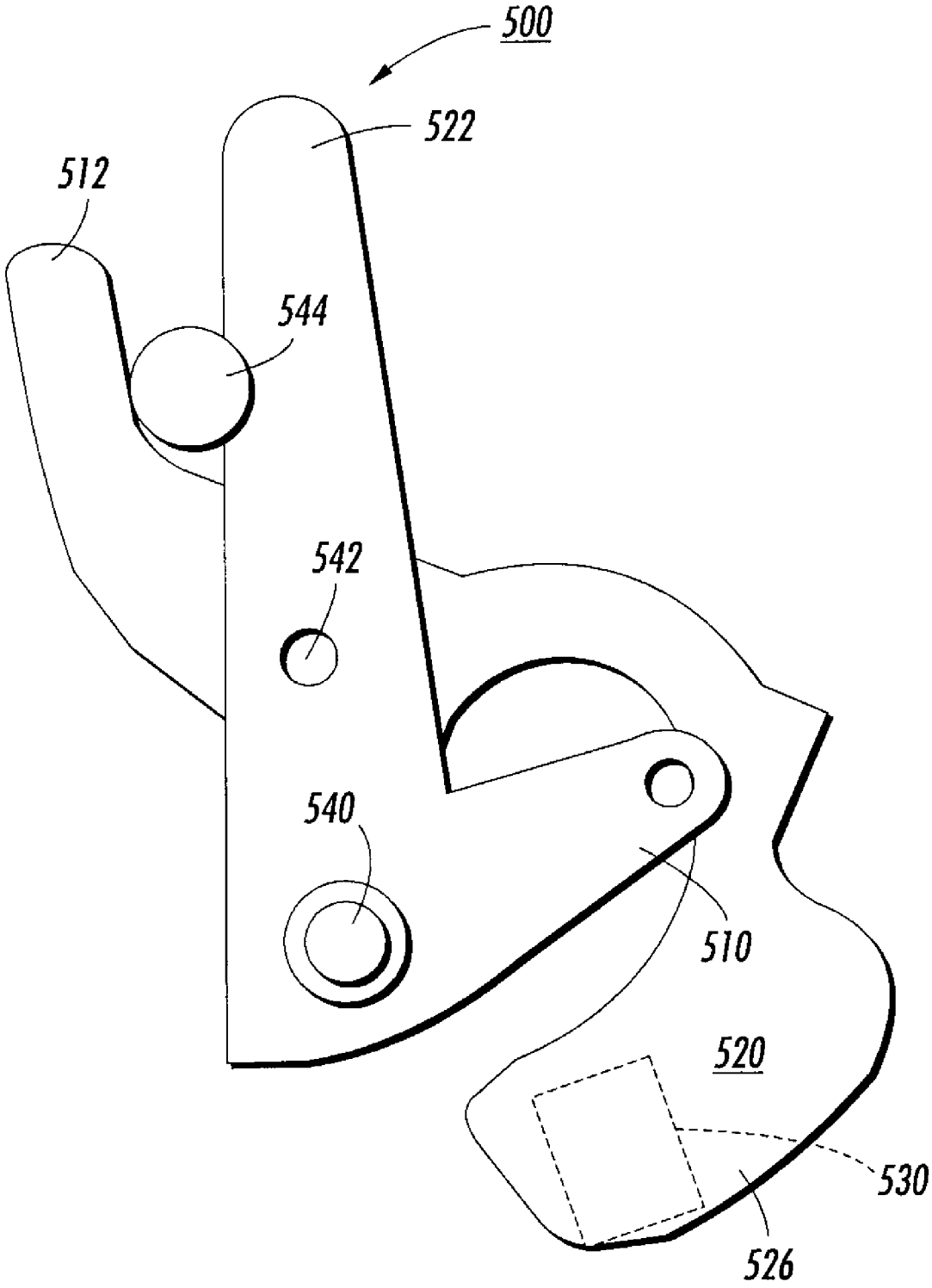

As the second flag body 520 contacts the fixed stop 544 and the first flag body 510 continues to rotate in the second direction, the second flag body 520 is rotated in a direction opposite to the second direction and into a second position of the second flag body 520. The change in the position of the first flag body 510 causes a change in the position of the second flag body 520. The change in the position of the second flag body 520 alters the signal that is received by the sensor 530. For example, the sensor 530 may be blocked from receiving the signal as the second flag body 520 moves into its second position. As shown in FIGS. 12 and 13, the second flag body 520 blocks the sensor 530 as the second flag body 520 moves into its second position, for example, by a second projection 526 of the second flag body 520.

As the object 300 continues in the first direction, a trailing edge of the object 300 will clear the first projection 512 of the first flag body 510, allowing the first flag body 510 to return to the first position, carrying the second flag body 520 to the first position in which the second flag body 520 allows the sensor 530 to receive an unaltered signal. For example, a biasing member may be used to help the first flag body 510 return to the first position.

As described above, the articulated flag member arrangement 500 detects an object traveling in the first direction along the processing path. The articulated flag member arrangement 500 also detects an object traveling along the processing path in a direction opposite to the first direction.

If the object 300 reverses direction and travels in a direction opposite to the first direction, the second flag body 520 of the articulated flag member arrangement 500 will be engaged. For example, as shown in FIG. 13, as the second flag body 520 is moved into its second position, the first projection 522 of the second flag body 520 may be extended further into the processing path which may facilitate contact of the first projection 522 of the second flag body 520 with the object 300 as the object 300 moves in the direction opposite to the first direction.

Figure 14:
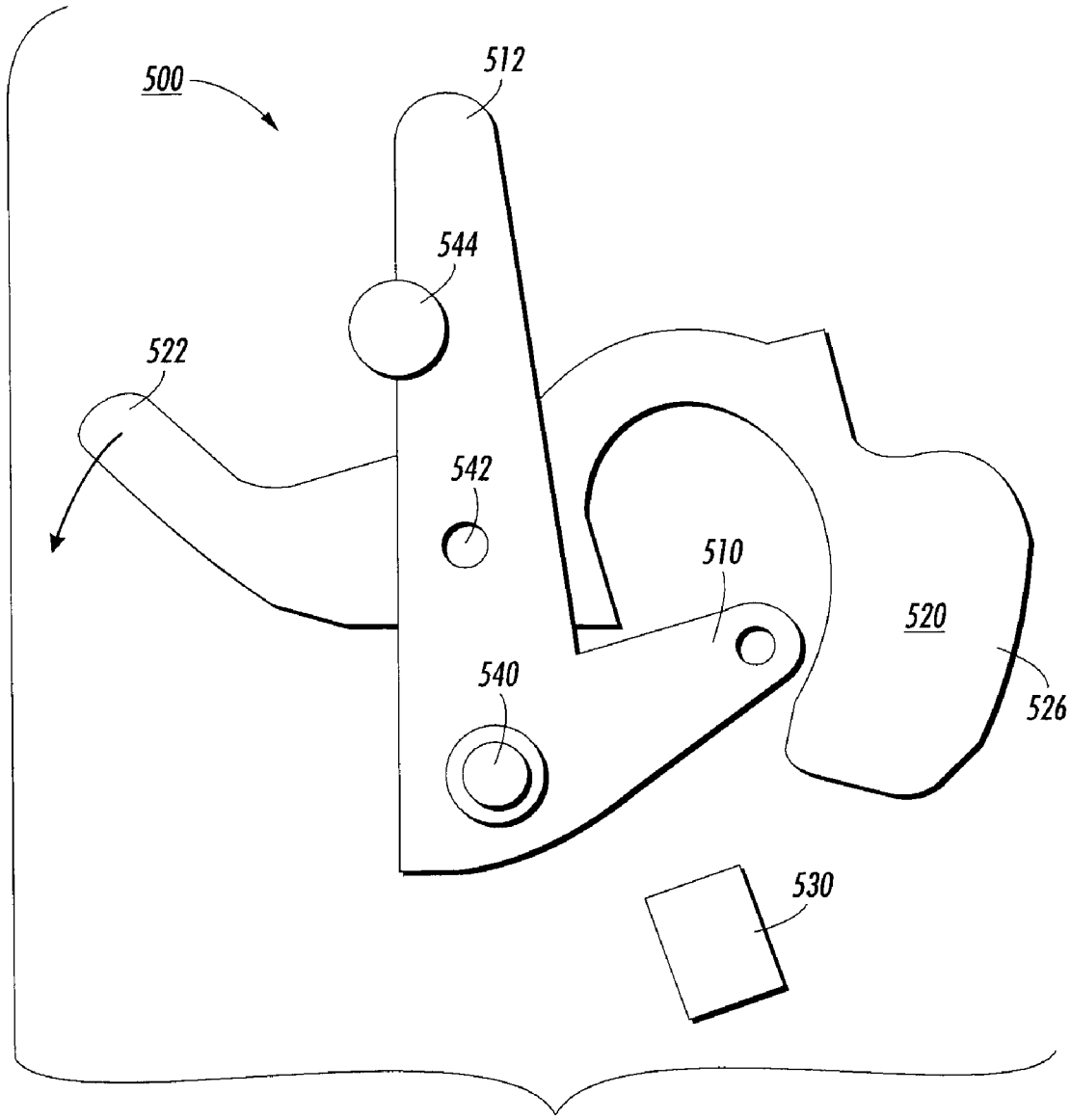

Because of this contact, movement of the object 300 in the direction opposite to the first direction causes the second flag body 520 to rotate in a direction opposite to the second direction into a third position, and to alter the signal received by the sensor 530. As shown in FIG. 14, when the second flag body 520 is in the third position, the sensor 530 is again unblocked. The change in the signal received by the sensor 530 indicates movement of the object 300 in the direction opposite to the first direction, whereby the articulated flag member arrangement 500 detects movement in the direction opposite to the first direction. Because the first and second flag bodies 510, 520 are pivotably connected, the articulated flag member arrangement 500 may detect movement of the object 300 in the direction opposite to the first direction within milliseconds, as discussed above with respect to the first exemplary embodiment.

The invention as described herein is exemplary only. It should be appreciated that the various embodiments described herein are not intended to be limiting. Rather, various modification and/or alternatives are readily apparent based on the foregoing disclosure.

The invention claimed is:

1. An articulated flag member arrangement, comprising:

a first flag body having a first projection, the first flag body pivotably connected to a device such that an object moving in a first direction and contacting the first projection of the first flag body rotates the first flag body in a second direction;

a second flag body having a first projection, the second flag body pivotably connected to the device such that an object moving in a direction opposite to the first direction and contacting the first projection of the second flag body rotates the second flag body in a direction opposite to the second direction, the first and second flag bodies being rotatable relative to each other and including first and second portions, respectively, arranged relative to each other to interact such that at least one of the first and second flag bodies rotates based on rotation of the other of the first and second flag bodies.

2. The arrangement of claim 1, wherein the second portion of the second flag body interacts with the first portion of the first flag body such that the first flag body rotates in the second direction based on rotation of the second flag body.

3. The arrangement of claim 2, wherein the second portion of the second flag body interacts with the first portion of the first flag body such that the first flag body rotates in the second direction based on rotation of the second flag body further than the first flag body rotates in the second direction when an object moving in the first direction contacts the first projection of the first flag body.

4. The arrangement of claim 2, wherein one of the first and second portions comprises a lateral projection that contacts the other of the first and second portions such that the first flag body rotates in the second direction based on rotation of the second flag body.

5. The arrangement of claim 4, wherein the other of the first and second portions comprises a curved surface that contacts the lateral projection of the one of the first and second portions such that the first flag body rotates in the second direction based on rotation of the second flag body.

6. The arrangement of claim 2, wherein one of the first and second portions comprises a curved surface that contacts the other of the first and the second portions such that the first flag body rotates in the second direction based on rotation of the second flag body.

7. The arrangement of claim 2, further comprising a sensor that receives a signal when the first flag body is in a first position, the sensor being located such that a second projection of the first flag body prevents the sensor from receiving the signal when an object moving in the first direction contacts the first projection of the first flag body and rotates the first flag body into a second position, and such that the sensor receives the signal when the first flag body rotates in the second direction, based on rotation of the second flag body, into a third position.

8. The arrangement of claim 7, wherein the first position of the first flag body is an at rest position of the first flag body.

9. The arrangement of claim 7, further comprising a biasing member that biases the first flag body toward the first position.

10. The arrangement of claim 7, further comprising a biasing member that biases the second flag body against rotation in the direction opposite to the second direction.

11. The arrangement of claim 1, wherein the first and second portions interact such that the second flag body rotates in the direction opposite to the second direction based on rotation of the first flag body.

12. The arrangement of claim 11, wherein the second flag body is pivotably connected to the first flag body.

13. The arrangement of claim 12, further comprising a stop that limits rotation of the second flag body in the second direction.

14. The arrangement of claim 11, further comprising a sensor that receives a signal when the second flag body is in a first position, the sensor being located such that a second projection of the second flag body prevents the sensor from receiving the signal when an object moving in a first direction contacts the first projection of the first flag body and rotates the second flag body into a second position, and such that the sensor receives the signal when an object moving in the direction opposite to the first direction contacts the first projection of the second flag body and rotates the second flag body in the direction opposite to the second direction into a third position.

15. The arrangement of claim 14, wherein the first position of the second flag body is an at rest position of the second flag body.

16. The arrangement of claim 14, further comprising a biasing member that biases the second flag body toward the first position.

17. The arrangement of claim 14, further comprising a biasing member that biases the first flag body toward an at rest position.

18. A method for detecting bi-directional passage of an object in a processing path using an articulated flag member arrangement, the articulated flag member arrangement including a first flag body having a first projection, the first flag body pivotably connected to a device, and a second flag body having a first projection, the second flag body pivotably connected to the device, the first and second flag bodies being rotatable relative to each other and including first and second portions, respectively, arranged relative to each other to interact with each other, the method comprising:

passing a signal relative to one of the first and second flag bodies, passage of the signal indicating one of an at-rest position and an operated position of one of the first and second flag bodies;

contacting the first projection of the first flag body with an object that is traveling in a processing path in a first direction, causing the first flag body to rotate in a second direction and to alter the passing of the signal; and contacting the first projection of the second flag body with an object that is traveling in a processing path in a direction opposite to the first direction, causing the second flag body to rotate in a direction opposite to the second direction and to alter the passing of the signal, wherein at least one of the rotation of the first flag body and the rotation of the second flag body is relative to the other of the first flag body and the second flag body.

19. The method of claim 18, further comprising interacting the second portion of the second flag body with the first portion of the first flag body such that the first flag body rotates in the second direction based on rotation of the second flag body.

20. The method of claim 18, further comprising interacting the first portion of the first flag body with the second portion of the second flag body such that the second flag body rotates in the direction opposite to the second direction based on rotation of the first flag body.

* * * * *